US010351984B2

(12) United States Patent
Tokuda et al.

(10) Patent No.: US 10,351,984 B2
(45) Date of Patent: Jul. 16, 2019

(54) SEWING MACHINE

(71) Applicant: YAMATO MISHIN SEIZO KABUSHIKI KAISHA, Osaka (JP)

(72) Inventors: Naoko Tokuda, Osaka (JP); Ryuichiro Kinoshita, Osaka (JP); Yasuo Kanegawa, Osaka (JP)

(73) Assignee: YAMATO MISHIN SEIZO KABUSHIKI KAISHA, Osaka (JP)

( * ) Notice: Subject to any disclaimer, the term of this patent is extended or adjusted under 35 U.S.C. 154(b) by 0 days.

(21) Appl. No.: 15/564,721

(22) PCT Filed: Apr. 14, 2016

(86) PCT No.: PCT/JP2016/061979
§ 371 (c)(1),
(2) Date: Oct. 5, 2017

(87) PCT Pub. No.: WO2016/167308
PCT Pub. Date: Oct. 20, 2016

(65) Prior Publication Data

US 2018/0112341 A1 Apr. 26, 2018

(30) Foreign Application Priority Data

Apr. 15, 2015 (JP) ..... 2015-083062

(51) Int. Cl.
*D05B 71/00* (2006.01)
*D05B 27/02* (2006.01)
*D05B 73/06* (2006.01)

(52) U.S. Cl.
CPC ..... *D05B 71/00* (2013.01); *D05B 27/02* (2013.01); *D05B 73/06* (2013.01)

(58) Field of Classification Search
CPC ..... D05B 71/00; D05B 71/02; D05B 71/04; D05B 27/02; D05B 27/08; D05B 73/06
See application file for complete search history.

(56) References Cited

U.S. PATENT DOCUMENTS 2,248,508 A * 7/1941 Myers ..... D05B 71/02 112/256
2,381,685 A * 8/1945 Parry ..... D05B 71/02 112/256

(Continued)

FOREIGN PATENT DOCUMENTS

CN 101581018 A 11/2009
JP 56-083391 A 7/1981

(Continued)

OTHER PUBLICATIONS

International Search Report for PCT/JP2016/061979, dated Jun. 21, 2016, with English translation from WIPO.

(Continued)

*Primary Examiner* — Danny Worrell
(74) *Attorney, Agent, or Firm* — Ladas & Parry, LLP

(57) ABSTRACT

Provided is a sewing machine including: a pair of feed bars that are incorporated in a cylinder and are each capable of conveying a material by moving to draw elliptical trajectories in side view; an oil seal abutting outer surfaces of the pair of feed bars by surrounding an entire periphery in a direction intersecting a longitudinal direction of the pair of feed bars; and a seal-supporting unit provided on an inner wall of the cylinder and configured to support the oil seal, wherein the pair of feed bars are configured to be movable upward through the opening of the cylinder, the seal-supporting unit includes an upper opening that allows the pair of feed bars to move upward, and the seal-supporting unit is immovable relative to the cylinder when the pair of feed bars move upward through the opening.

6 Claims, 15 Drawing Sheets

(56) References Cited

U.S. PATENT DOCUMENTS 2,483,036 A * 9/1949 Christensen ..... D05B 3/02 112/256
3,418,955 A * 12/1968 Attwood ..... D05B 71/00 112/256
3,785,310 A * 1/1974 Marforio ..... D05B 71/00 112/256
4,075,960 A * 2/1978 Klundt ..... D05B 71/00 112/256
4,284,019 A 8/1981 Marchesi
4,487,143 A * 12/1984 Hiltner ..... D05B 71/00 112/256
4,708,070 A * 11/1987 Hiltner ..... D05B 13/00 112/10
4,809,628 A * 3/1989 Kleinschmidt ..... D05B 27/02 112/256
6,779,472 B1 * 8/2004 Green ..... D05B 23/009 112/470.15
8,443,633 B1 * 5/2013 Inli ..... D04B 1/108 66/148
8,893,529 B1 * 11/2014 Inli ..... D05B 23/009 66/148
2001/0039816 A1 * 11/2001 Fujiwara ..... D04B 15/06 66/13
2017/0283997 A1 * 10/2017 Nocenti ..... D04B 9/40
2018/0112341 A1 * 4/2018 Tokuda ..... D05B 27/02

FOREIGN PATENT DOCUMENTS

JP 2009-273482 A 11/2009
JP 5374069 12/2013
JP 2014-004137 A 1/2014

OTHER PUBLICATIONS

Written Opinion of the International Search Authority for PCT/JP2016/061979, dated Jun. 21, 2016, with machine translation from Bing.com Microsoft Translator.
International Preliminary Report on Patentability for PCT/JP2016/061979, dated Oct. 26, 2017, with English translation from WIPO.
Written Opinion of the international Search Authority for PCT/JP2016/061979, dated Jun. 21, 2016, with English translation from WIPO.
Office action with search report from Taiwanese Patent Application No. 105111684 dated Apr. 8, 2019, and its English translation.

* cited by examiner

SEWING MACHINE

CROSS-REFERENCE TO RELATED APPLICATIONS

This application is the US National Phase of PCT Application PCT/JP2016/061979 filed on Apr. 14, 2016, which claims priority to Japanese Patent Application No. 2015-083062, filed on Apr. 15, 2014, the disclosures of which are incorporated herein by reference in their entireties.

FIELD

The present invention relates to a sewing machine including an oil seal on a feed bar that is incorporated in a cylinder for conveying a material.

BACKGROUND

In a sewing machine, a pair of rod-like feed bars are incorporated in a cylinder, in order to convey a material for sequentially performing sewing. One feed bar and the other feed bar constituting the pair of feed bars are arranged parallel to each other on the left and right sides with respect to the longitudinal direction of the cylinder. Material feeders having feed dogs with projections and recesses are attached respectively to the distal ends of the feed bars. The respective feed bars move to draw elliptical trajectories in side view so that the feed dogs project and retract from the upper surface of a stitch plate. By the movement of the respective feed bars, the material located on the stitch plate is pressed by material feeders to be conveyed in one direction.

Oil is supplied to the feed bars for lubrication of the portions where the feed bars abut each other and lubrication between the inner wall of the cylinder and each feed bar. If the supplied lubricating oil reaches the material feeders at the distal ends of the feed bars along the surfaces of the feed bars, the lubricating oil adheres to the material, which is a problem. In order to prevent this problem, there are sewing machines including oil seals provided in feed bars. Such a sewing machine is disclosed, for example, in Patent Literature 1 as a "feed-off-arm-type sewing machine".

In the sewing machine disclosed in Patent Literature 1, a rectangular plate-shaped oil seal (which is described as an "oil cutting tool" in Patent Literature 1) is attached so as to surround the periphery of a pair of feed bars. The oil seal is supported by a support frame fixed to a cylinder by screwing. The support frame is also substantially rectangular with four corners closed and is arranged so as to surround the periphery of the feed bars.

With the structure of the sewing machine disclosed in Patent Literature 1, a gap may possibly occur between the support frame and the inner wall of the cylinder when attaching the support frame to the inner wall of the cylinder, and if the lubricating oil passes through the gap, the lubricating oil reaches the distal ends of the feed bars. Therefore, in order to prevent oil leakage more reliably, a sealant is applied between the support frame and the inner wall of the cylinder. As such a sealant, a material that is in liquid form when applied and is solidified after the application is used, for example.

The cylinder has an opening that is open upward and is generally covered by a cover part. For the maintenance of the feed bars, the cover part is detached from the opening, and the pair of feed bars are raised upward so as to project through the opening. The oil seal and the support frame are arranged so as to surround the periphery of the pair of feed bars and therefore are raised together with the pair of feed bars.

The support frame disclosed in Patent Literature 1 is present so as to surround the periphery of the feed bars, and therefore it is necessary for maintenance of the feed bars to remove the screw fixing the support frame to the cylinder and to remove the sealant applied between the support frame and the inner wall of the cylinder once. Therefore, regardless of whether or not the oil seal is to be replaced in the maintenance, it has been necessary to remove the sealant at each time of maintenance of the feed bars and apply the sealant again after the completion of maintenance. In this way, the maintenance work of feed bars has been conventionally inconvenient.

CITATION LIST

Patent Literature

Patent Literature 1: Japanese Patent No. 5374069 (FIG. 5 to FIG. 8)

SUMMARY

Technical Problem

In view of the aforementioned problem, it is an object of the present invention to provide a sewing machine that enables easy maintenance of feed bars.

Solution to Problem

The present invention is a sewing machine including: a cylinder having an opening that is open upward; a stitch plate attached to a portion in the cylinder where sewing is performed; a pair of feed bars incorporated in the cylinder, each of the feed bars having a rod shape and being capable of conveying a material on the stitch plate by moving to draw elliptical trajectories in side view; an oil feeder provided at a position in the sewing machine corresponding to a proximal end side of the pair of feed bars and configured to supply lubricating oil to the pair of feed bars; an oil seal abutting outer surfaces of the pair of feed bars by surrounding an entire periphery in a direction intersecting a longitudinal direction of the pair of feed bars at a position between the stitch plate and the oil feeder; and a seal-supporting unit provided on an inner wall of the cylinder and configured to support the oil seal, wherein the pair of feed bars are configured to be movable upward through the opening of the cylinder, the seal-supporting unit includes an upper opening that allows the pair of feed bars to move upward, and the seal-supporting unit is immovable relative to the cylinder when the pair of feed bars move upward through the opening.

Further, an upper seal-supporting unit detachably attached to the oil seal and configured to support an upper part of the oil seal by being arranged in the upper opening when mounted can be provided.

Further, the seal-supporting unit can include side-supporting parts configured to support one side part and the other side part of the oil seal in longitudinal view of the feed bars.

Further, the seal-supporting unit can include slide-supporting parts that allow the oil seal to be insertable in the up-down direction while the seal-supporting unit is immovable relative to the cylinder.

DESCRIPTION OF EMBODIMENTS

Next, the present invention will be described with reference to an embodiment. In the following description, the directions are expressed as directions in the state where the components are incorporated into a sewing machine 1. Further, the "lateral direction" is the lateral direction in longitudinal view of a cylinder 3. Further, the "left-right direction" means the left-right direction in longitudinal view of the cylinder 3 as seen from the distal end side to the proximal end side of the cylinder 3. Further, the "front-rear direction" means a direction with the distal end direction (material-conveyance destination direction) of the cylinder 3 being on the rear side and the proximal end direction (material-conveyance source direction) of the cylinder 3 being on the front side.

Figure 1:
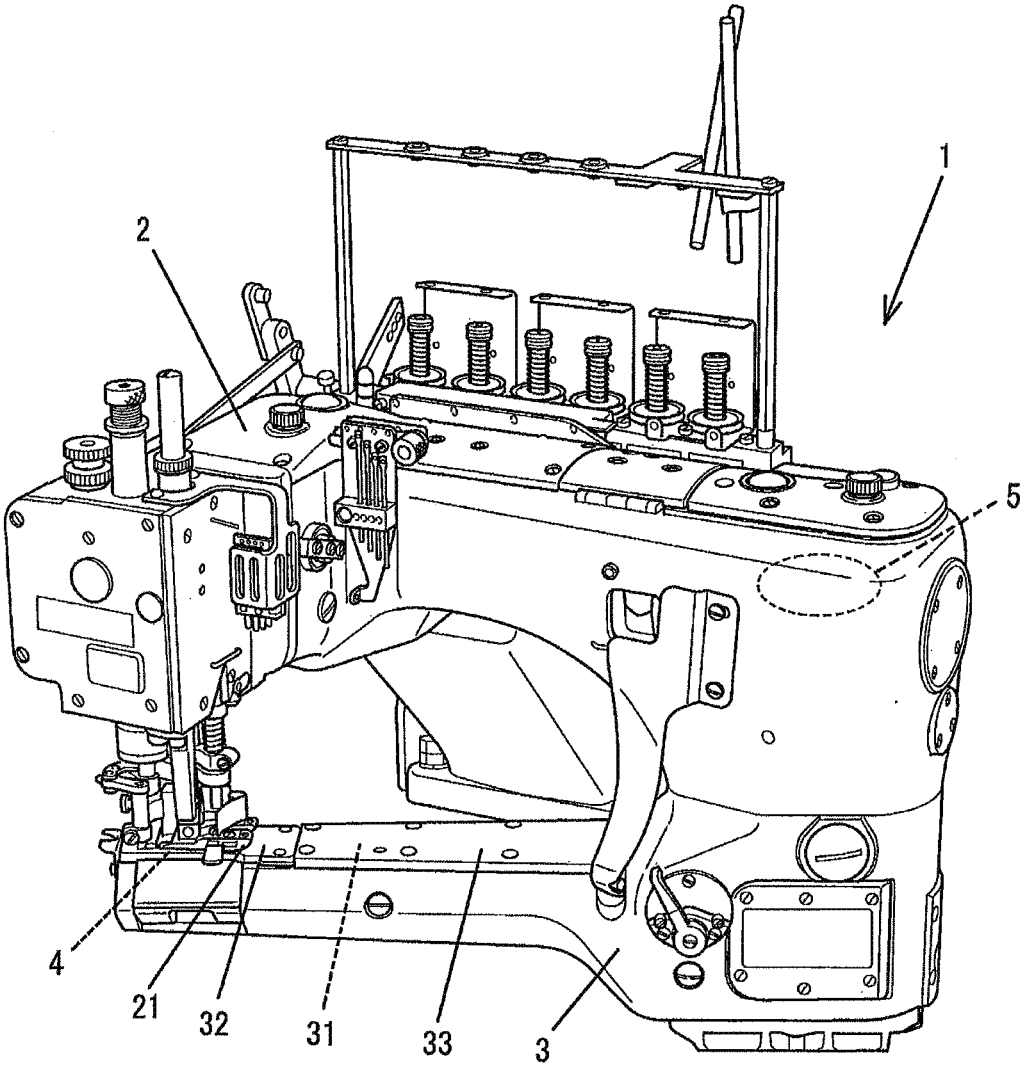
FIG. 1 is a perspective view showing a sewing machine of this embodiment.

The sewing machine 1 of this embodiment is a feed-off-arm-type sewing machine. The sewing machine 1 is used for an operation to feed off a material along the cylinder in parallel while sewing it into a cylindrical shape, such as sleeve closing sewing for underwears, T-shirts, or the like, and crotch sewing for briefs, underpants, or the like. As shown in FIG. 1, the sewing machine 1 includes a sewing machine arm 2 located on an upper side, and the cylinder 3 located below the sewing machine arm 2 and extending obliquely with respect to the longitudinal direction of the sewing machine arm 2. A sewing operator performs a sewing operation while being located in front of the sewing machine arm 2 and the cylinder 3 so as to hold the sewing machine 1 in the operator's arms.

Figure 2:
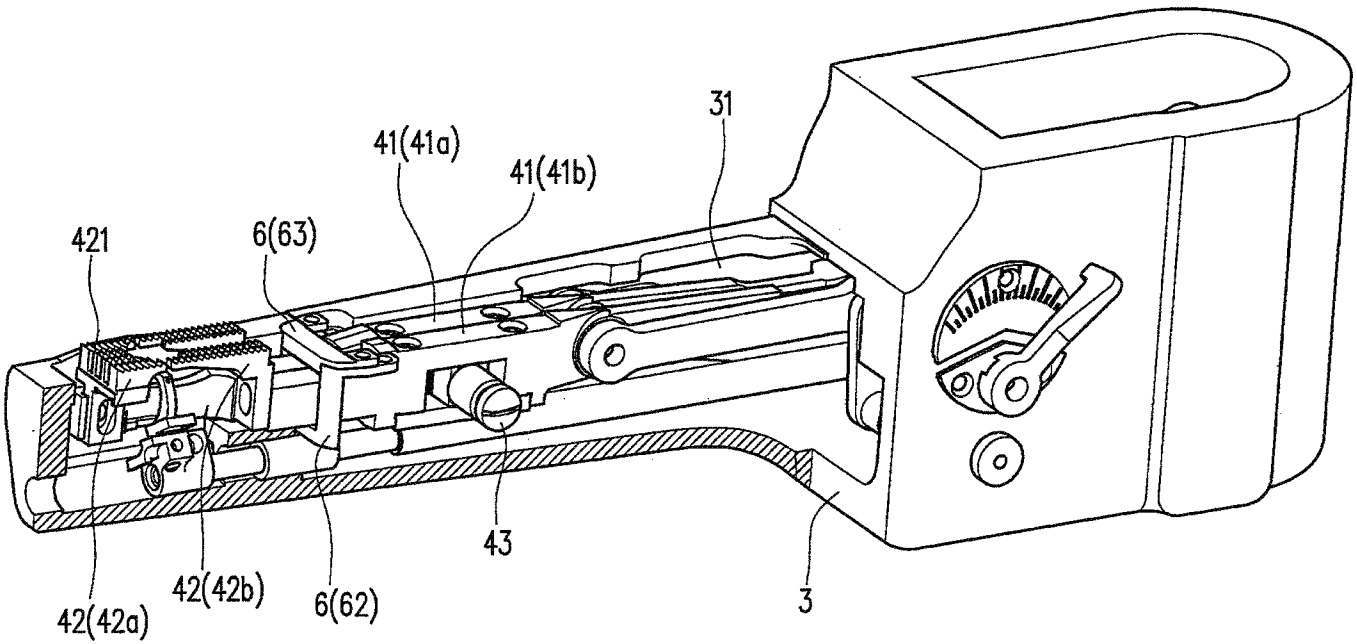
FIG. 2 is a perspective view showing a cylinder and the mechanism inside the cylinder in the sewing machine of this embodiment, in the state where the halves of a stitch plate, a cover part, and the cylinder on the near side are removed.

The sewing machine 1 includes a plurality of needles (not shown) that are reciprocally moved up and down by a needle driving mechanism incorporated in the sewing machine arm 2 and are arranged parallel to each other in the left-right direction. Further, the sewing machine 1 includes a material presser 21 configured to press the material to be sewn from above, and a stitch plate 32 that is located below the needles and is fixed to the upper rear surface of the cylinder 3. The stitch plate 32 has holes (needle drop slots) through which the needles reciprocally moving up and down can pass. Further, a material-feeding mechanism 4 is provided in the periphery of the needle drop slots in the stitch plate 32. As shown in FIG. 2, the material-feeding mechanism 4 includes a pair of feed bars 41 (41*a* and 41*b*) each having a rod shape, incorporated in the cylinder 3, and arranged parallel to each other on the left and right sides, and one set of material feeders 42 (42*a* and 42*b*) attached respectively to the distal ends of the feed bars 41*a* and 41*b*. Each of the material feeders 42*a* and 42*b* has a feed dog 421 composed of a plurality of projections and recesses and configured to move relative to the stitch plate 32. The feed dog 421 can convey the material pressed by the material presser 21 from above unidirectionally and intermittently by projecting and retracting from the upper surface of the stitch plate 32.

Figure 3:
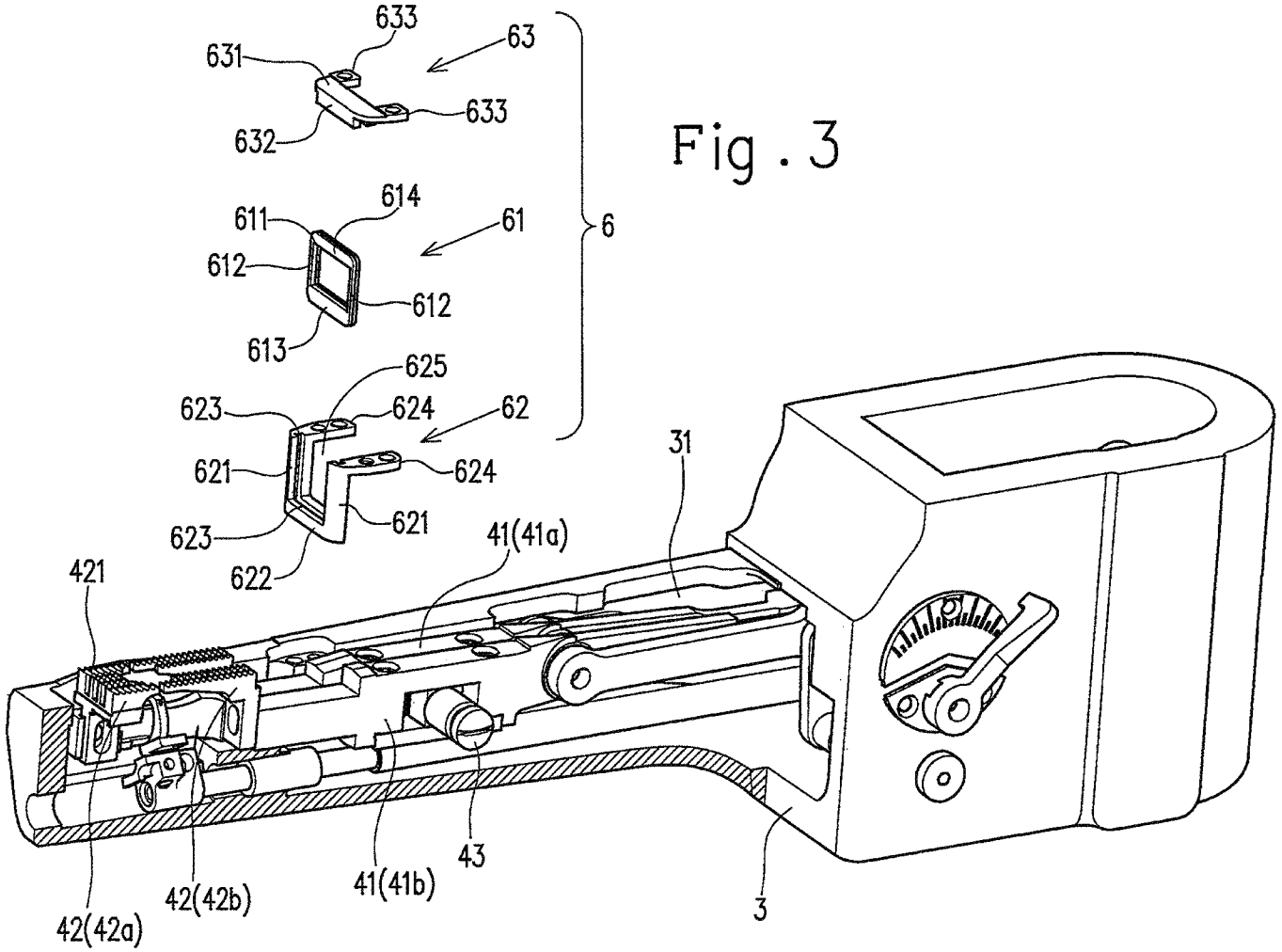
FIG. 3 is a perspective view showing an oil seal unit disassembled from the state shown in FIG. 2.

As shown in FIG. 2 and FIG. 3, the cylinder 3 has an opening 31 that is open upward. As shown in FIG. 1, the stitch plate 32 is attached to a portion in the rear region of the opening 31 of the cylinder 3 where the sewing is performed (that is, below the needles). A cylinder cover 33 configured to cover the opening 31 from above is attached in the region of the opening 31 that is located more on the front side than the region where the stitch plate 32 is located. The opening 31 is closed by the stitch plate 32 and the cylinder cover 33.

Figure 9:
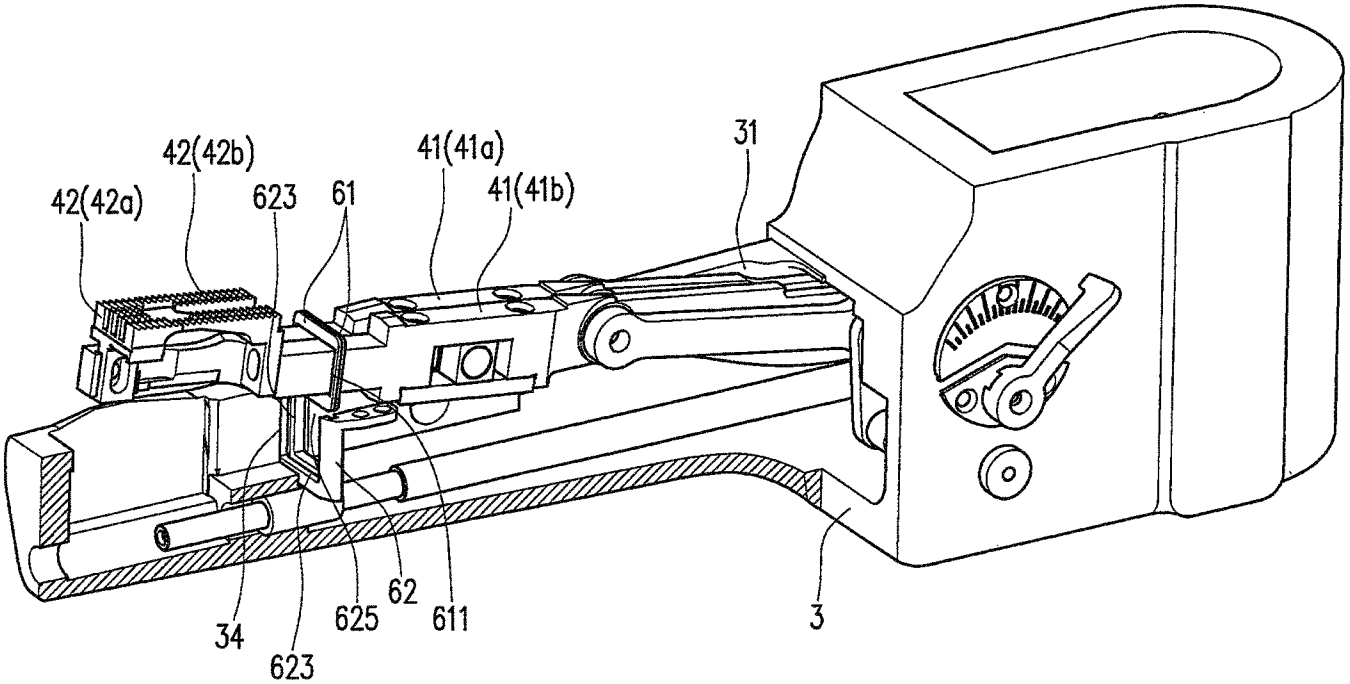
FIG. 9 is a perspective view showing the state shown in FIG. 2 with the upper seal-supporting unit detached and the feed bars raised.
Figure 10:
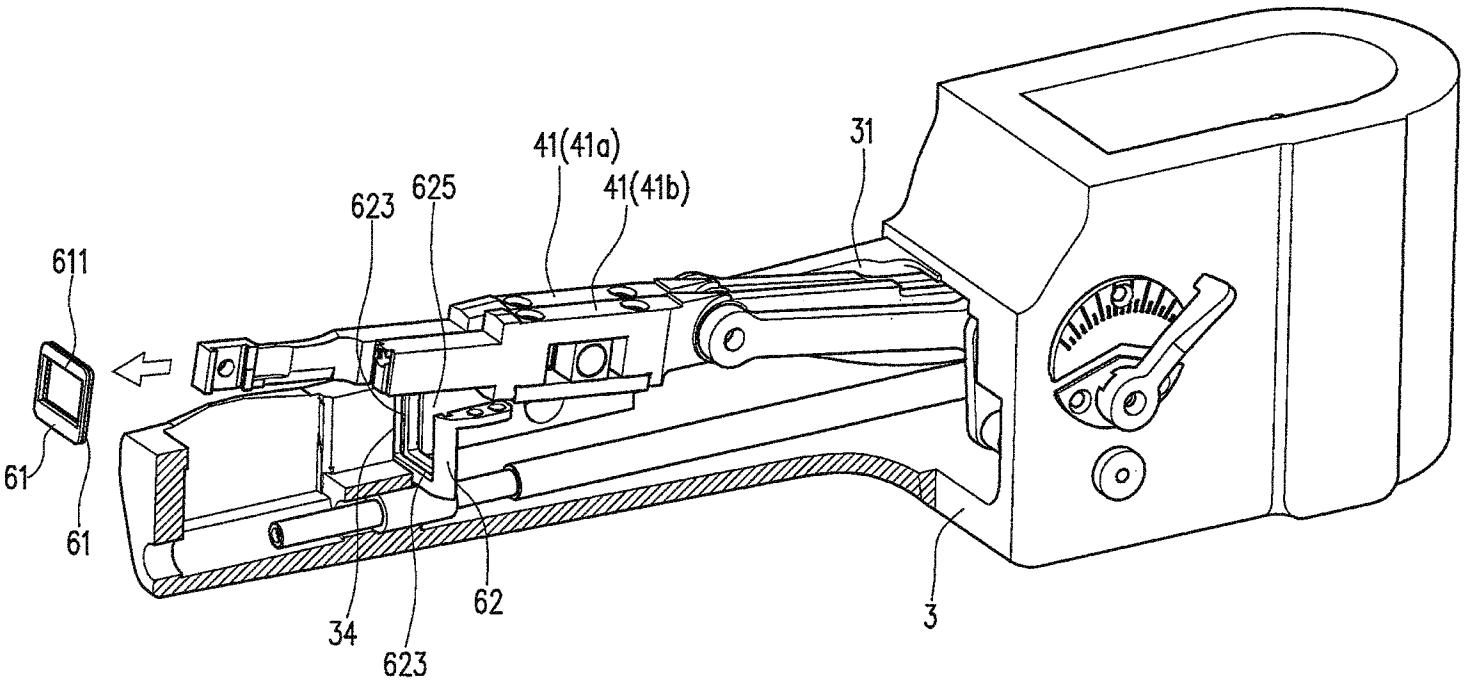
FIG. 10 is a perspective view showing the state shown in FIG. 9 with the oil seal detached.

As shown in FIG. 2 and FIG. 3, the pair of feed bars 41 are incorporated in the cylinder 3 along the longitudinal direction. The pair of feed bars 41 are constituted by the rear feed bar (referred to also as "main feed bar") 41*a* located on the left side and the front feed bar (referred to also as "differential feeder") 41*b* located on the right side, when the front side of the cylinder 3 is viewed from the rear side thereof along the longitudinal direction of the cylinder 3. A feed bar-supporting shaft 43 passes through the pair of feed bars 41 in the left-right direction. The feed bar-supporting shaft 43 supports the pair of feed bars 41 so as to allow the pair of feed bars 41 to move in the front-rear direction and the rotational direction within a specific range. Therefore, the feed bars 41*a* and 41*b* move to reciprocate back and forth and rotate about the feed bar-supporting shaft 43 while being supported by the feed bar-supporting shaft 43 in side view. Further, the feed bars 41*a* and 41*b* can convey the material on the stitch plate 32 unidirectionally by moving to draw elliptical trajectories with their distal ends (rear edges) to which the one set of material feeders 42 are attached. A known configuration can be employed as a configuration for moving the feed bars 41*a* and 41*b* to draw elliptical trajectories. Further, the rear feed bar 41*a* and the front feed bars 41*b* can move to draw different trajectories particularly in the front-rear direction. In this case, it is possible to differentiate the material feeders 42*a* and 42*b* in the front-rear direction (that is, to make a difference in the dimension of the material to be fed (material-feeding dimension) in the front-rear direction). Of course, it is also possible not to differentiate them (that is, not to make a difference in the material-feeding dimension in the front-rear direction). Then, the pair of feed bars 41 are configured to be capable of moving upward through the opening 31 of the cylinder 3 in maintenance or the like, as shown in FIG. 9 and FIG. 10.

The sewing machine 1 of this embodiment includes an oil feeder 5 configured to supply lubricating oil to the pair of feed bars 41. Only the position of the oil feeder 5 is shown by the dashed line in FIG. 1, and the specific shape thereof is not shown. However, the oil feeder 5 is housed in the sewing machine 1 (more specifically, in the sewing machine arm 2) and is provided at a position corresponding to the proximal end side of the pair of feed bars 41. The oil feeder 5 is configured to drop lubricating oil to hit the internal mechanisms of the sewing machine arm 2 and the cylinder 3, thereby scattering the lubricating oil into spray form, so that the lubricating oil adheres to the internal mechanisms. The lubricating oil in spray form adheres also to the surfaces of the pair of feed bars 41. Thus, the pair of feed bars 41 are lubricated with oil. The specific configuration of the oil feeder 5 is not limited, and various configurations may be employed.

An oil seal unit 6 is attached to the pair of feed bars 41. Thereby, oil seals 61 abut the outer surfaces of the pair of feed bars 41 so as to surround the entire periphery in a direction intersecting the longitudinal direction of the pair of feed bars 41, at a position between the stitch plate 32 and the oil feeder 5. More specifically, the mounting position of the oil seal unit 6 is a position that does not prevent the movement of the lubricating oil supplied to the pair of feed bars 41 by the oil feeder 5, for smooth movement of the pair of feed bars 41. Further, it is a position that can prevent the supplied lubricating oil from reaching the stitch plate 32 (more specifically, the hole formed in the stitch plate 32 so as to allow the feed dog 421 to project and retract therethrough).

Figure 4:
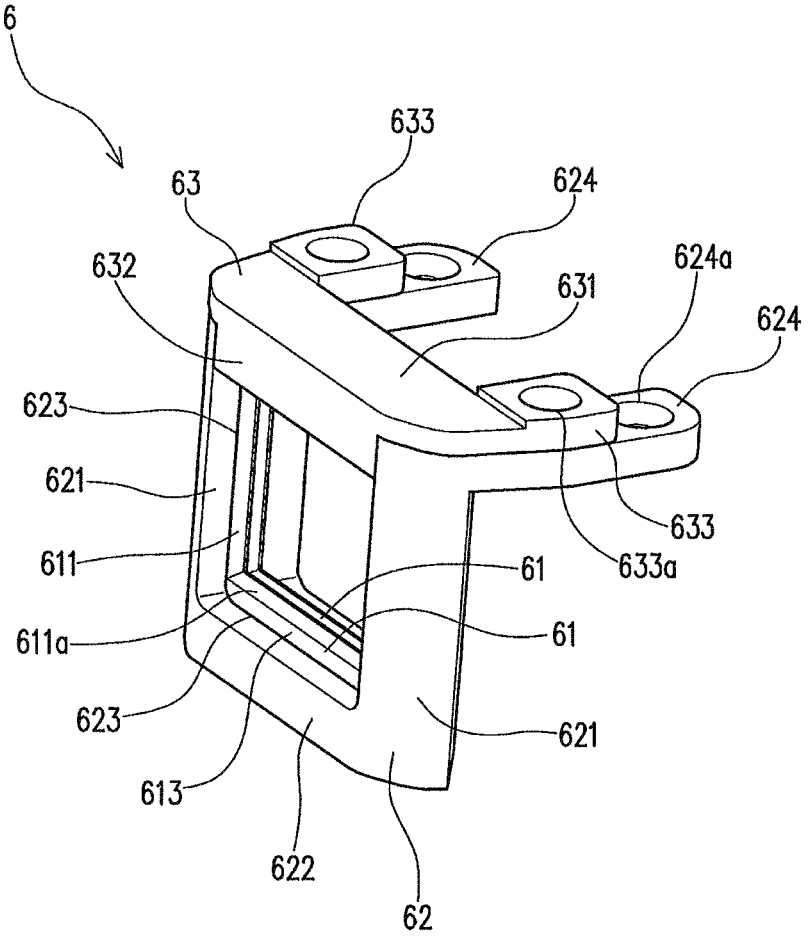
FIG. 4 is a perspective view showing the oil seal unit in the sewing machine of this embodiment.

As shown in FIG. 3 and FIG. 4, the oil seal unit 6 is constituted by the two pieces of oil seals 61, a seal-supporting unit 62, and an upper seal-supporting unit 63.

Figure 8:
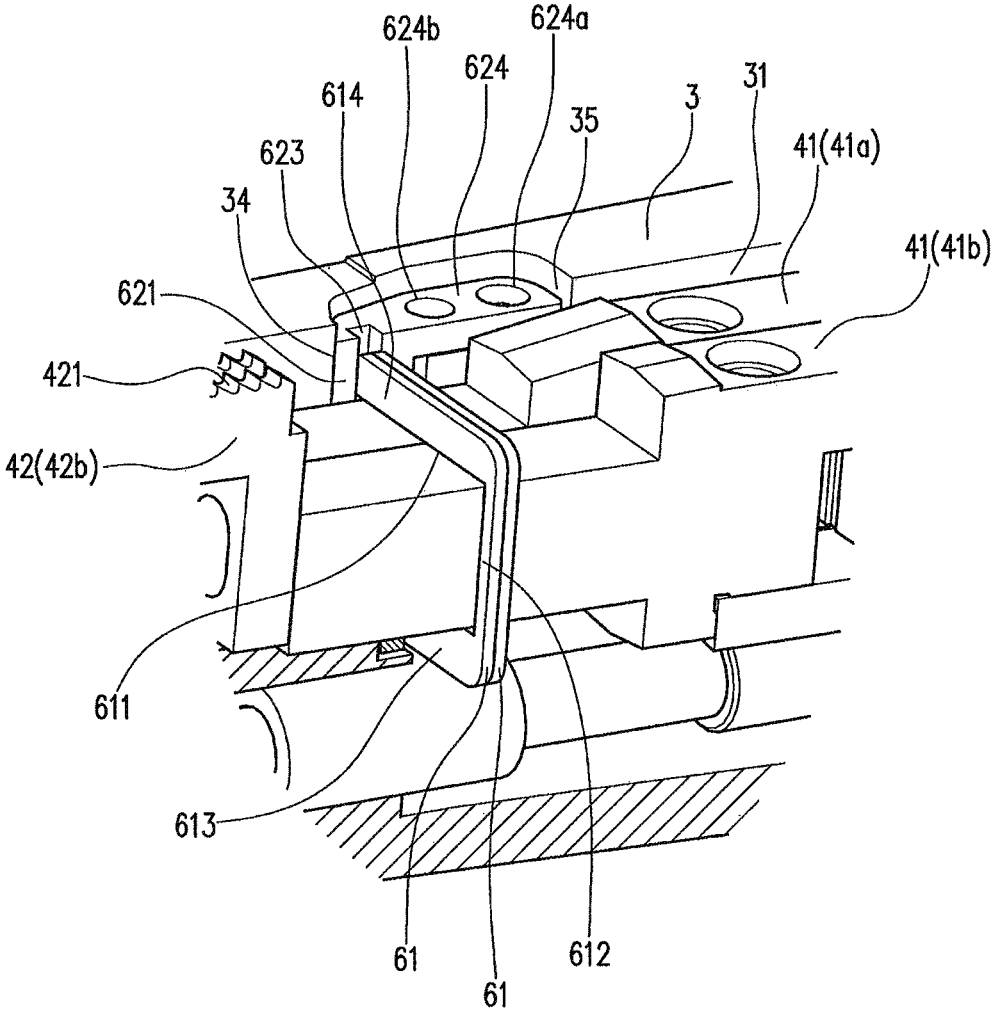
FIG. 8 is a longitudinal sectional perspective view showing a main part of the seal-supporting unit in the state shown in FIG. 7.

As shown in FIG. 8, each oil seal 61 is a flat plate-shaped material made of a soft resin. In the oil seal unit 6 of this embodiment, the two oil seals 61 having the same shape and layered in the thickness direction are used. Each oil seal 61 has a rectangular outline in plan view and includes a rectangular through hole 611 in plan view at the center. The pair of feed bars 41 pass through the through hole 611. The through hole 611 is formed to be slightly smaller than the shape in vertical cross-sectional view of the portions of the pair of feed bars 41 where the oil seals 61 abut. Thereby, the gap through which the lubricating oil passes does not occur between the open edge of the through hole 611 and the outer surfaces of the pair of feed bars 41. However, the through hole 611 allows the pair of feed bars 41 to pass therethrough so as to allow the pair of feed bars 41 to slide by moving in the front-rear direction.

As described above, the pair of feed bars 41 move to draw elliptical trajectories. The entirety of each oil seal 61 follows the component in the up-down direction of the movement. More specifically, each oil seal 61 moves up and down along an oil-seal mounting groove 623 of the seal-supporting unit 62. As the pair of feed bars 41 move to draw elliptical trajectories, the pair of feed bars 41 are inclined with respect to the plane direction (and the up-down direction) of the oil seals 61. The two-layered oil seals 61 are displaced from each other in the plane direction against the inclined pair of feed bars 41. That is, one of the oil seals 61 is displaced upward, and the other of the oil seals 61 is displaced downward. Thereby, each oil seal 61 can correspond to the inclination while maintaining its sealing properties. Further, for the component in the front-rear direction of the movement, the pair of feed bars 41 slide within the through hole 611 of each oil seal 61 supported by the seal-supporting unit 62. That is, the pair of feed bars 41 are displaced from each other against the oil seal 61 in the front-rear direction. With the sliding, the lubricating oil present on the surfaces of the pair of feed bars 41 is scraped off by the inner edge of the through hole 611. The inner edge surface 611*a* of the through hole 611 is formed as an inclined surface that is inclined in the opening direction of the through hole 611 (see FIG. 4). Therefore, the inner edge of the through hole 611 comes almost in line contact with the surfaces of the pair of feed bars 41 at the top of its inclined surface, and therefore it is possible to correspond to the inclination of the pair of feed bars 41 and the movement in the front-rear direction of the pair of feed bars 41, while suppressing the deflection in the peripheral portion of the through hole 611 in each oil seal 61.

As shown in FIG. 3 and FIG. 4, in the oil seal 61, side parts 612 located on the left and right sides with the through hole 611 interposed therebetween and a lower part 613 located immediately below the through hole 611 are supported by the seal-supporting unit 62. This supporting is performed while the movement in the up-down direction following the movement of the pair of feed bars 41 is allowed. Further, in the oil seal 61, an upper part 614 located immediately above the through hole 611 is located in an upper opening 625 of the seal-supporting unit 62 (see FIG. 7) and thus is not supported by the seal-supporting unit 62 but is supported by the upper seal-supporting unit 63 attached to the seal-supporting unit 62. This supporting is performed while the movement in the up-down direction following the movement of the pair of feed bars 41 is allowed.

As shown in FIG. 4, the side edges of the through hole 611 is located slightly inward of inner side edges of side parts 621 of the seal-supporting unit 62. Meanwhile, the upper end edge of a lower part 622 of the seal-supporting unit 62 and the lower edge of the through hole 611 are spaced apart from each other in the up-down direction (relatively largely as compared with the distance between the side edges). Likewise, the lower edge of a seal support piece 632 of the upper seal-supporting unit 63 and the upper edge of the through hole 611 are also spaced apart from each other in the up-down direction. Therefore, each oil seal 61 engaged with the seal-supporting unit 62 and the upper seal-supporting unit 63 has the lower part 613 and the upper part 614 partially exposed to a space surrounded by the seal-supporting unit 62 and the upper seal-supporting unit 63. The movement in the up-down direction of the oil seals 61 following the movement of the pair of feed bars 41 occurs within the range of the vertical dimension in the parts where the lower part 613 and the upper part 614 are partially exposed. Therefore, the pair of feed bars 41 do not collide with the upper end edge of the lower part 622 of the seal-supporting unit 62 and the lower edge of the seal support piece 632 of the upper seal-supporting unit 63.

Figure 5:
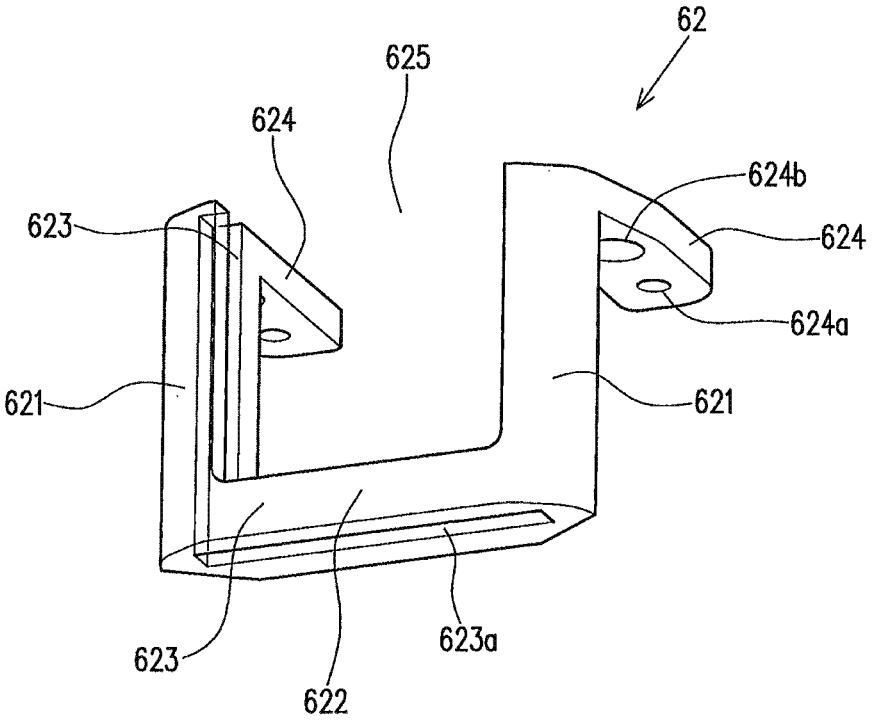
FIG. 5 is a perspective view showing a seal-supporting unit in the sewing machine of this embodiment as seen from below.

The seal-supporting unit 62 supports the oil seals 61 which are provided on the inner wall of the cylinder 3 and through which the pair of feed bars 41 pass (see FIG. 7 and FIG. 8) while allowing the movement in the up-down direction. As shown in FIG. 5, the seal-supporting unit 62 includes the side parts 621 as side-supporting parts configured to support the side parts 612 on the left and right of the oil seals 61 from the lateral sides and the lower part 622 configured to connect the lower ends of the two side parts 621, and is substantially U-shaped in longitudinal view of the cylinder 3. The spacing between the inner surfaces of the side parts 621 is formed to be larger than the width dimension of the pair of feed bars 41. The oil seals 61 are supported by the side parts 621 on the left and right sides, thereby preventing the seal-supporting unit 62 from hindering the upward movement of the one set of feed bars 41 while maintaining the sealing properties on the lateral sides of the oil seals 61.

Further, the oil-seal mounting groove 623 configured to engage the oil seals 61 with the seal-supporting unit 62 is formed on the inner circumferences of the side parts 621 and the lower part 622. As shown in FIG. 5 (in which the position inside the side part 621 only on the left side of the oil-seal mounting groove 623 is shown by the dashed line), the oil-seal mounting groove 623 in the side parts 621 is formed to have a larger dimension than the thickness dimension of the two oil seals 61 that are layered in the width dimension (front-rear dimension) and a uniform depth in the up-down direction. The side parts 612 of the oil seals 61 are located within the oil-seal mounting groove 623. Therefore, the oil seals 61 are supported by the side parts 621 as slide-supporting parts so as to be removably inserted in the up-down direction, while the seal-supporting unit 62 is immovable relative to the cylinder 3. This configuration allows the vertical movement (more specifically, the sliding movement in the up-down direction) of the oil seals 61 following the movement of the pair of feed bars 41. Further, the oil seals 61 can be attached to or detached from the seal-supporting unit 62 only by insertion or removal to give the state shown in FIG. 9. Therefore, the procedure to perform maintenance of the pair of feed bars 41 can be simplified.

Figure 6:
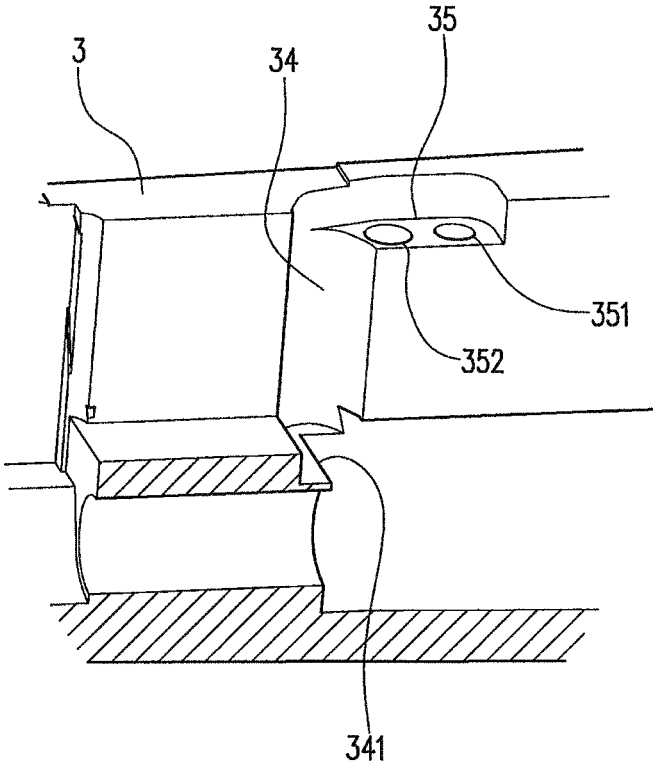
FIG. 6 is an enlarged longitudinal sectional perspective view (perspective view as seen from above) showing a main part of the inner wall of the cylinder in the sewing machine of this embodiment.

Further, the oil-seal mounting groove 623 in the lower part 622 is formed in the left-right direction, and the lower part 613 of each oil seal 61 is located therein. The oil-seal mounting groove 623 in the lower part 622 has an opening as an oil drain hole 623*a* at the lower end of the lower part 622, and the lubricating oil entering the oil-seal mounting groove 623 is discharged downward through the oil drain hole 623*a*. As shown in FIG. 6, a cutout 341 is formed in a seal-supporting unit-mounting groove 34 of the cylinder 3, and thus there is a space below the oil drain hole 623*a*. Therefore, the discharged lubricating oil falls down to the bottom of the cylinder 3.

Further, cylinder-fixing parts 624 are formed forward from the upper ends of the side parts 621 of the seal-supporting unit 62. As shown in FIG. 5, each of the cylinder-fixing parts 624 includes a through hole 624*a* through which a screw for attaching the seal-supporting unit 62 to the cylinder 3 passes and a through hole 624*b* through which a screw for attaching the upper seal-supporting unit 63 to the cylinder 3 passes.

Further, as shown in FIG. 9, the seal-supporting unit 62 includes the upper opening 625 having a space that allows the upward movement of the pair of feed bars 41, while the seal-supporting unit 62 is immovable relative to the cylinder 3, when the pair of feed bars 41 move upward through the opening 31 of the cylinder 3. The upper opening 625 of this embodiment is a portion interposed between the upper end parts of the side parts 621.

In order to attach the seal-supporting unit 62, the seal-supporting unit-mounting groove 34 is formed on the inner wall of the cylinder 3, and a seal-supporting unit-fixing part 35 that is a recess is formed on the upper end face of the cylinder 3, as shown in FIG. 6. In this embodiment, the seal-supporting unit-fixing part 35 is formed more on the front side than the upper end of the seal-supporting unit-mounting groove 34. The seal-supporting unit 62 is fitted into the seal-supporting unit-mounting groove 34 from above (see FIG. 7 and FIG. 8), and the cylinder-fixing parts 624 are fixed to the seal-supporting unit-fixing part 35 with screws (not shown) after the fitting. Therefore, screw holes 351 and 352 are open in the seal-supporting unit-fixing part 35. As the screw holes, the screw hole 351 for fixing the seal-supporting unit 62 is formed on the front side, and the screw hole 352 for fixing the upper seal-supporting unit 63 is formed on the rear side. A sealant is applied between the seal-supporting unit 62 and the seal-supporting unit-mounting groove 34 after the fitting and fixing with screws of the seal-supporting unit 62. This prevents leakage of the lubricating oil toward the rear side (toward the material-feeding mechanism 4 side) of the seal-supporting unit 62. It is also possible to apply a sealant in advance before the fitting and fixing with screws of the seal-supporting unit 62.

As shown in FIG. 4, the upper seal-supporting unit 63 is arranged in the upper opening 625 to support the upper parts of the oil seals 61, when mounted on the seal-supporting unit 62. The upper seal-supporting unit 63 includes a cover part 631 covering the side parts 621 and the upper opening 625 of the seal-supporting unit 62 from above, the seal support piece 632 projecting below the cover part 631, detachably attached to the upper part 614 of each of the oil seals 61, and arranged to sandwich the oil seals 61 from the front and rear sides when mounted, and cylinder-fixing parts 633 for attachment to the cylinder 3. Each of the cylinder-fixing parts 633 includes a through hole 633*a* through which a screw for attaching the upper seal-supporting unit 63 to the cylinder 3 passes.

When the upper seal-supporting unit 63 is mounted on the seal-supporting unit 62, the spacing between the lower part 622 of the seal-supporting unit 62 and the seal support piece 632 of the upper seal-supporting unit 63 is formed to be larger than the range of the vertical movement of the pair of feed bars 41. Further, the cylinder-fixing parts 633 are respectively stacked on the cylinder-fixing parts 624 of the seal-supporting unit 62 from above when the upper seal-supporting unit 63 is attached to the cylinder 3. At this time, the through hole 633*a* coincides with the through hole 624*b* of each of the cylinder-fixing parts 624.

Since the upper part (the upper part 614) of each of the oil seals 61 can be supported by the upper seal-supporting unit 63, the upper part of each of the oil seals 61 is less likely to deflect, so that the sealing properties of the oil seals 61 can be improved.

Next, the way to perform the maintenance of the pair of feed bars 41 in the sewing machine 1 of this embodiment in which the oil seal unit 6 configured as above is formed inside the cylinder 3 will be described.

Figure 7:
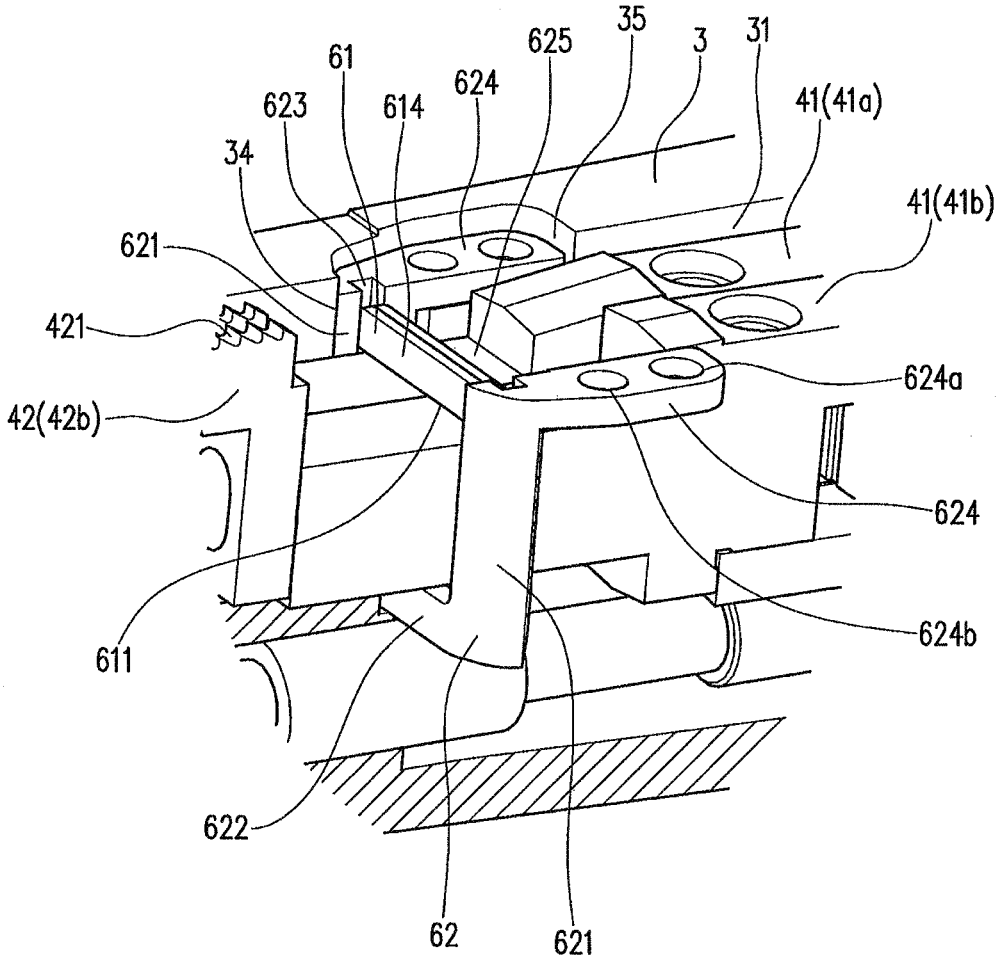
FIG. 7 is a longitudinal sectional perspective view showing a main part in the state shown in FIG. 2 with an upper seal-supporting unit removed.

Prior to the maintenance, the needles and the material presser 21 are detached from the sewing machine arm 2, and the stitch plate 32 and the cylinder cover 33 are detached from the cylinder 3. Next, as shown in FIG. 7, the upper seal-supporting unit 63 is detached from the cylinder 3 and the seal-supporting unit 62. Then, the feed bar-supporting shaft 43 is detached from the pair of feed bars 41. Then, as shown in FIG. 9, the pair of feed bars 41 are raised so as to exit through the opening 31. When being raised, the pair of feed bars 41 move upward, passing through the space of the upper opening 625 of the seal-supporting unit 62. At this time, the oil seals 61 move to exit upward along the oil-seal mounting groove 623 in the side parts 621 of the seal-supporting unit 62. The pair of feed bars 41 thus raised have the distal end side at a high level and the proximal end side at a low level, as shown in FIG. 9. Although FIG. 9 shows the state where the one set of material feeders 42 are attached to the pair of feed bars 41, the one set of material feeders 42 may be detached from the pair of feed bars 41 before the raising. Thus, the oil seals 61 in the pair of feed bars 41 can be located above the opening 31 of the cylinder 3.

In the state shown in FIG. 9, the distal ends of the pair of feed bars 41 are located above the opening 31 of the cylinder 3. Therefore, in order to replace the oil seals 61, the one set of material feeders 42 are first detached from the pair of feed bars 41. Then, as shown in FIG. 10, the oil seals 61 can be detached from the pair of feed bars 41 by being moved (specifically slid) to the distal end side.

After the oil seals 61 are replaced and set at predetermined positions, or in the state as they are in the case where the oil seals 61 are not moved relative to the pair of feed bars 41 for visual inspection or the like, the pair of feed bars 41 are lowered to be housed in the cylinder 3 by the reverse procedure of the aforementioned raising.

Conventionally, the support frame of the oil seal (oil cutting tool) disclosed, for example, in Patent Literature 1 (Japanese Patent No. 5374069) has been formed into a rectangular frame shape in longitudinal view of the cylinder. Therefore, when the pair of feed bars move upward through the opening of the cylinder, the support frame is moved together with the pair of feed bars. Therefore, it has been impossible to move the pair of feed bars upward while the support frame is immovable relative to the cylinder. In contrast, the seal-supporting unit 62 of this embodiment is substantially U-shaped in longitudinal view of the cylinder 3 and thus has the upper opening 625. Therefore, while the seal-supporting unit 62 is immovable relative to the cylinder 3, the pair of feed bars 41 are allowed to move upward. Therefore, even in the case where the feed bars 41 are raised, the seal-supporting unit 62 can remain in the cylinder 3, and therefore there is no need to apply the sealant that has been applied between the seal-supporting unit 62 and the cylinder 3 again. Further, the seal-supporting unit 62 is not detached from the cylinder 3 basically, and thus the state as shipped from the factory can be maintained. Therefore, assembly errors or the like in the maintenance on the user side can be reduced. In this way, the configuration of the sewing machine 1 including the seal-supporting unit 62 of the present embodiment has great merit as compared with conventional techniques.

Hereinbefore, the embodiment of the present invention has been described, but the present invention is not limited to the aforementioned embodiment, and various modifications can be made without departing from the gist of the present invention.

For example, the type of the sewing machine to which the present invention is applied is not limited to a feed-off-arm-type sewing machine, and the present invention can be applied to various types of sewing machines such as a feed-in-arm-type sewing machine.

Figure 11A:
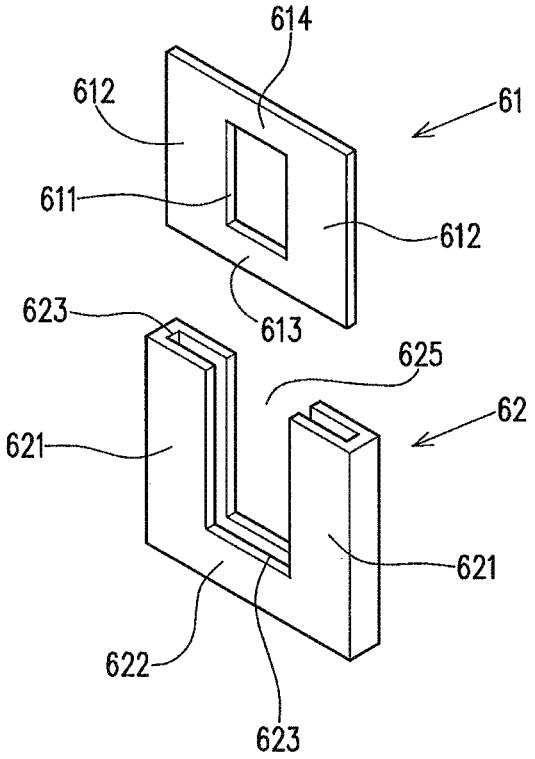
FIG. 11A is a perspective view schematically showing an oil seal unit in another embodiment.

Further, the configuration of the oil seal unit 6 is also not limited to the aforementioned embodiment, and various modifications can be made. For example, it is also possible to omit the upper seal-supporting unit 63 so that only the seal-supporting unit 62 supports the oil seals 61 with the upper opening 625 exposed. In this case, for example, as shown in FIG. 11A, the width dimension of the side parts 612 of each oil seal 61 can be more enlarged than in the aforementioned embodiment, and the width dimension of the side parts 621 of the seal-supporting unit 62 can be enlarged likewise. In the example shown in FIG. 11A, the width dimension of the side parts 612 is larger than the width dimension of the lower part 613 and the upper part 614 of each oil seal 61. Further, the width dimension of the side parts 621 is larger than the width dimension of the lower part 622 of the seal-supporting unit 62. Such a configuration allows the width dimension of the upper opening 625 to be relatively smaller than the width dimension of the oil seals 61 and the seal-supporting unit 62. Accordingly, the deflection of the upper part 614 of the oil seals 61 following the movement of the pair of feed bars 41 can be less likely to occur. Therefore, a reduction in sealing properties can be suppressed even if the upper seal-supporting unit 63 is omitted.

Figure 11B:
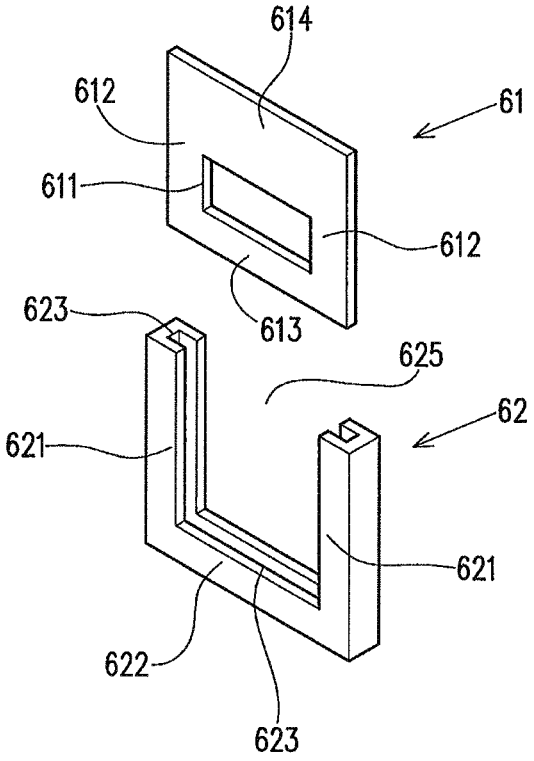
FIG. 11B is a perspective view schematically showing an oil seal unit in another embodiment.

Further, in the case where the upper seal-supporting unit 63 is omitted, the vertical dimension of the upper part 614 of each of the oil seals 61 can be more enlarged than in the aforementioned embodiment, and the vertical dimension of the side parts 621 of the seal-supporting unit 62 can be enlarged likewise, as shown in FIG. 11B. In the example shown in FIG. 11B, the width dimension of the upper parts 614 is larger than the width dimension of the lower part 613. Such a configuration can strengthen the support from the lateral sides of the oil seals 61 by the degree to which the side parts 621 of the seal-supporting unit 62 are enlarged. Therefore, the deflection of the upper part 614 of each of the oil seals 61 following the movement of the pair of feed bars 41 can be less likely to occur. Therefore, a reduction in sealing properties can be suppressed even if the upper seal-supporting unit 63 is omitted.

Figure 12A:
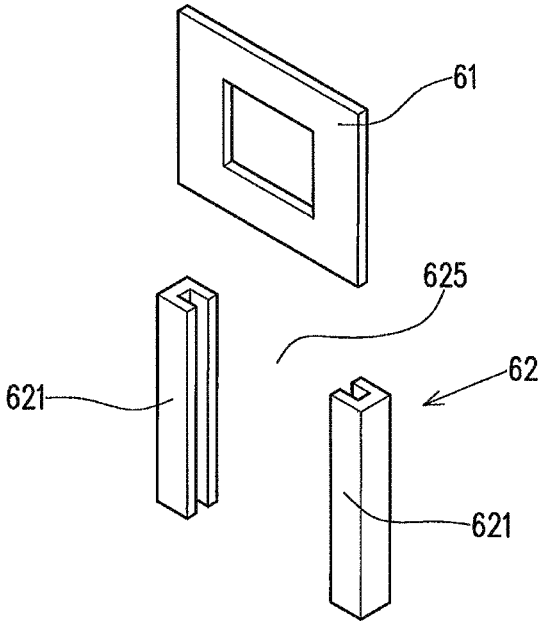
FIG. 12A is a perspective view schematically showing an oil seal unit in another embodiment.
Figure 12B:
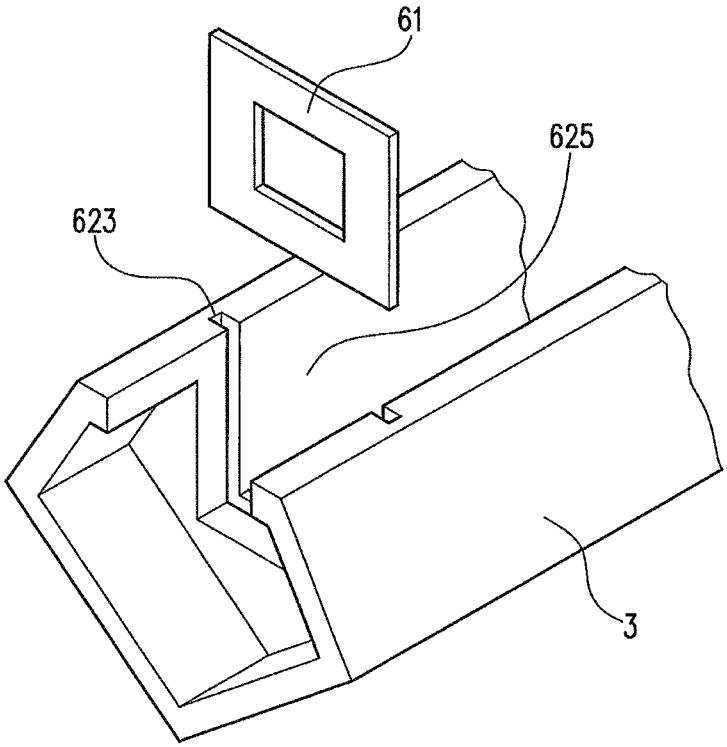
FIG. 12B is a perspective view schematically showing an oil seal unit in another embodiment.

Further, as shown in FIG. 12A, it is also possible to omit the lower part 622 in the seal-supporting unit 62 and constitute the seal-supporting unit 62 by two members on the left and right. Further, as shown in FIG. 12B, it is also possible to omit the seal-supporting unit 62 by directly forming the oil-seal mounting groove 623 on the inner wall of the cylinder 3. Such a configuration can be achieved, for example, by dividing the cylinder 3 before and after the mounting position of the oil seal unit 6. Further, though not shown in the figures, the seal-supporting unit 62 can be undetachably attached to the cylinder 3 as a separate body from the cylinder 3.

Figure 13:
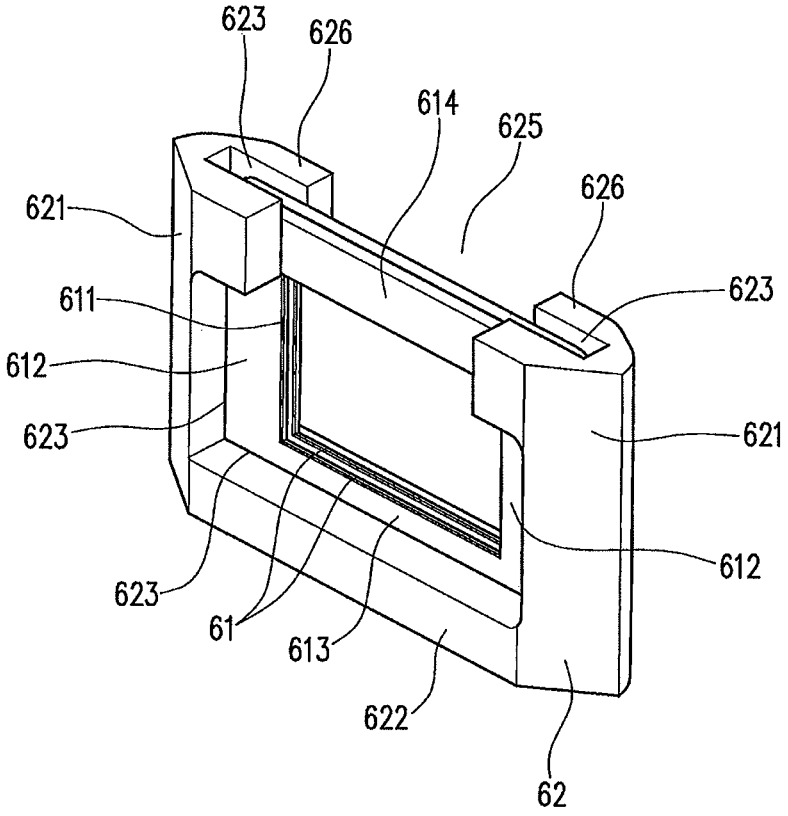
FIG. 13 is a perspective view showing an oil seal unit in another embodiment.

Further, the upper opening 625 of the seal-supporting unit 62 is interposed between the upper end parts of the side parts 621 in the aforementioned embodiment, but there is no limitation to this configuration. For example, as shown in FIG. 13 (where the cylinder-fixing parts 624 are omitted), it is also possible to form projecting members 626 that project inwardly from the upper end parts of the side parts 621, so that the upper opening 625 is defined between the inner surfaces of the projecting members 626. In this configuration, the oil-seal mounting groove 623 is formed in each of the projecting members 626. In this configuration, it is possible to support the upper part 614 of each of the oil seals 61 depending on the setting of the dimension of the projecting members 626. Therefore, the upper seal-supporting unit 63 may be omitted depending on the case.

Further, in the aforementioned embodiment, the oil seals 61 having a flat plate shape are engaged with the oil-seal mounting groove 623 formed in the seal-supporting unit 62. That is, there is a relationship with the oil-seal mounting groove 623 being recessed and the oil seals 61 projecting, but there is no limitation to this configuration. For example, conversely to the aforementioned embodiment, for example, a projecting ridge formed in the seal-supporting unit 62 and a groove formed on the end edge of each of the oil seals 61 can be engaged with each other.

Further, in the aforementioned embodiment, the two pieces of oil seals 61 having the same shape are layered, but one piece of oil seal 61 or three or more pieces of oil seals 61 may be used. Further, in the case of using a plurality of oil seals 61, all of them do not necessarily have the same shape, and oil seals 61 having different shapes or different thickness may be combined. Further, the oil seals 61 are not limited to the material having a flat plate shape and can have a bellows shape, for example.

Further, it is also possible to configure the cylinder cover 33 to function also as the upper seal-supporting unit 63 by forming the oil seals 61 with the same shape as the seal support piece 632 of the upper seal-supporting unit 63 on the lower surface of the cylinder cover 33.

Finally, the configuration and action of the aforementioned embodiment (including modifications) will be summarized. The aforementioned embodiment is a sewing machine 1 including: a cylinder 3 having an opening 31 that is open upward; a stitch plate 32 attached to a portion in the cylinder 3 where sewing is performed; a pair of feed bars 41 incorporated in the cylinder 3, each of the feed bars 41 having a rod shape and being capable of conveying a material on the stitch plate 32 by moving to draw elliptical trajectories in side view; an oil feeder 5 provided at a position in the sewing machine 1 corresponding to a proximal end side of the pair of feed bars 41 and configured to supply lubricating oil to the pair of feed bars 41; an oil seal 61 abutting outer surfaces of the pair of feed bars 41 by surrounding an entire periphery in a direction intersecting a longitudinal direction of the pair of feed bars 41 at a position between the stitch plate 32 and the oil feeder 5; and a seal-supporting unit 62 provided on an inner wall of the cylinder 3 and configured to support the oil seal 61, wherein the pair of feed bars 41 are configured to be movable upward through the opening 31 of the cylinder 3, the seal-supporting unit 62 includes an upper opening 625 that allows the pair of feed bars 41 to move upward, and the seal-supporting unit 62 is immovable relative to the cylinder 3 when the pair of feed bars 41 move upward through the opening 31.

According to this configuration, while the seal-supporting unit 62 is immovable relative to the cylinder 3, the pair of feed bars 41 can be raised from the cylinder 3 by passing through the upper opening 625 of the seal-supporting unit 62. Therefore, even in the case where the pair of feed bars 41 are raised, there is no need to apply the sealant applied between the seal-supporting unit 62 and the cylinder 3 again.

Further, an upper seal-supporting unit 63 detachably attached to the oil seal 61 and configured to support an upper part of the oil seal 61 by being arranged in the upper opening 625 when mounted can be provided.

According to this configuration, the upper part of the oil seal 61 can be supported by the upper seal-supporting unit 63, and therefore the upper part of the oil seal 61 is less likely to deflect. Therefore, the sealing properties of the oil seal 61 can be improved.

Then, the seal-supporting unit 62 can include side parts 621 as side-supporting parts configured to support a side part 612 on the right and a side part 612 on the left of the oil seal 61 in longitudinal view of the feed bars 41.

According to this configuration, the oil seal 61 is supported on the left and right sides by the side parts 621 as side-supporting parts. Thereby, it is possible to prevent the seal-supporting unit 62 from hindering the upward movement of the pair of feed bars 41 while maintaining the sealing properties on the lateral sides.

Further, the seal-supporting unit 62 can include the side parts 621 as slide-supporting parts that allow the oil seal 61 to be insertable in the up-down direction while the seal-supporting unit 62 is immovable relative to the cylinder 3.

According to this configuration, the oil seal 61 can be attached to or detached from the seal-supporting unit 62 by insertion or removal. Therefore, the procedure to perform maintenance of the pair of feed bars 41 can be simplified.

As described above, according to the configuration, even in the case where the pair of feed bars 41 are raised, there is no need to apply the sealant applied between the seal-supporting unit 62 and the cylinder 3 again. Therefore, it is possible to perform maintenance of the feed bars 41 easily.

REFERENCE SIGNS LIST

1 Sewing machine
3 Cylinder
31 Opening
32 Stitch plate
4 Material-feeding mechanism
41 Pair of feed bars
5 Oil feeder
6 Oil seal unit
61 Oil seals
612 Side parts of oil seals
614 Upper part of oil seals
62 Seal-supporting unit
621 Side-supporting part, Slide-supporting part, Side parts of seal-supporting unit
625 Upper opening
63 Upper seal-supporting unit

The invention claimed is:

1. A sewing machine comprising:

a cylinder having an opening that is open upward;

a stitch plate attached to a portion in the cylinder where sewing is performed;

a pair of feed bars incorporated in the cylinder, each of the feed bars having a rod shape and being capable of conveying a material on the stitch plate by moving to draw elliptical trajectories in side view;

an oil feeder provided at a position in the sewing machine corresponding to a proximal end side of the pair of feed bars and configured to supply lubricating oil to the pair of feed bars;

an oil seal abutting outer surfaces of the pair of feed bars by surrounding an entire periphery in a direction intersecting a longitudinal direction of the pair of feed bars at a position between the stitch plate and the oil feeder; and a seal-supporting unit provided on an inner wall of the cylinder and configured to support the oil seal, wherein the pair of feed bars are configured to be movable upward through the opening of the cylinder, the seal-supporting unit includes an upper opening that allows the pair of feed bars to move upward, and the seal-supporting unit is immovable relative to the cylinder when the pair of feed bars move upward through the opening to replace the oil seal.

2. The sewing machine according to claim 1, further comprising:

an upper seal-supporting unit that is detachably attached to the oil seal and is configured to support an upper part of the oil seal by being arranged in the upper opening when mounted.

3. The sewing machine according to claim 1, wherein the seal-supporting unit comprises a side-supporting part configured to support one side part and the other side part of the oil seal in longitudinal view of the feed bars.

4. The sewing machine according to claim 1, wherein the seal-supporting unit comprises a slide-supporting part that allows the oil seal to be insertable in the up-down direction while the seal-supporting unit is immovable relative to the cylinder.

5. The sewing machine according to claim 2, wherein the seal-supporting unit comprises a side-supporting part configured to support one side part and the other side part of the oil seal in longitudinal view of the feed bars.

6. The sewing machine according to claim 2, wherein the seal-supporting unit comprises a slide-supporting part that allows the oil seal to be insertable in the up-down direction while the seal-supporting unit is immovable relative to the cylinder.

* * * * *